US012680201B2

(12) United States Patent
Zhang et al.

(10) Patent No.: US 12,680,201 B2
(45) Date of Patent: Jul. 14, 2026

(54) METHOD FOR PRODUCING PROFILED FIBERS HAVING LOW BROKEN FILAMENT RATE BY POLYESTER FDY PROCESS

(71) Applicant: JIANGSU HENGLI CHEMICAL FIBRE CO., LTD., Suzhou (CN)

(72) Inventors: Jianguang Zhang, Suzhou (CN); Yonglin Zou, Suzhou (CN); Xinzhao Hu, Suzhou (CN); Lixin Yin, Suzhou (CN); Shunjun Yang, Suzhou (CN); Chengqian Zhu, Suzhou (CN); Yu Li, Suzhou (CN); Shouzuo Liu, Suzhou (CN)

(73) Assignee: JIANGSU HENGLI CHEMICAL FIBRE CO., LTD., Suzhou (CN)

( * ) Notice: Subject to any disclaimer, the term of this patent is extended or adjusted under 35 U.S.C. 154(b) by 0 days.

(21) Appl. No.: 19/114,473

(22) PCT Filed: Sep. 22, 2023

(86) PCT No.: PCT/CN2023/120534
§ 371 (c)(1),
(2) Date: Mar. 24, 2025

(87) PCT Pub. No.: WO2024/061335
PCT Pub. Date: Mar. 28, 2024

(65) Prior Publication Data

US 2026/0002293 A1 Jan. 1, 2026

(30) Foreign Application Priority Data

Sep. 23, 2022 (CN) ..... 202211162613.6

(51) Int. Cl.
*D01H 13/30* (2006.01)
*D01H 13/02* (2006.01)
(Continued)

(52) U.S. Cl.
CPC ..... *D01H 13/306* (2013.01); *D01H 13/02* (2013.01); *D01H 13/04* (2013.01); *D01H 13/32* (2013.01)

(58) Field of Classification Search
CPC ..... D01H 13/306; D01H 13/02; D01H 13/04; D01H 13/32
See application file for complete search history.

(56) References Cited

FOREIGN PATENT DOCUMENTS

CN 101139741 A 3/2008
CN 110565180 A 12/2019
(Continued)

OTHER PUBLICATIONS

FZ/T 50054-2021, Man-made fiber-On-line and intelligent detection of appearance defects for yarn package, China National Standards, 2021, pp. 1-12, Ministry of Industry and Information Technology of the People's Republic of China.

*Primary Examiner* — Mathieu D Vargot
(74) *Attorney, Agent, or Firm* — Bayramoglu Law Offices LLC

(57) ABSTRACT

A method for preparing profiled fibers with low lousiness rate by a polyester FDY process is provided, when preparing profiled fibers by the FDY process, during the operation of a yarn path, the horizontal and longitudinal positions of wire guide ceramic pieces on the pre-entangling wire guide frame are adjusted to maintain vertical alignment of the filament bundle in the pre-entangling device and achieve optimal jitter effect, to prepare profiled fibers with a low lousiness rate; when the profiled fibers are triangular profiled fibers, the lousiness rate is 0.35-0.65%; when the profiled fibers are trilobal profiled fibers, the lousiness rate is 0.85-1.25%; when the profiled fibers are flat profiled fibers, the lousiness rate is 0.5-0.85%.

11 Claims, 13 Drawing Sheets

(51) Int. Cl.
*D01H 13/04* (2006.01)
*D01H 13/32* (2006.01)

(56) References Cited

FOREIGN PATENT DOCUMENTS

| | | | |
|---|---|---|---|
| CN | 212152512 | U | 12/2020 |
| CN | 215209826 | U | 12/2021 |
| CN | 115233325 | A | 10/2022 |
| JP | H0333210 | A | 2/1991 |

METHOD FOR PRODUCING PROFILED FIBERS HAVING LOW BROKEN FILAMENT RATE BY POLYESTER FDY PROCESS

CROSS REFERENCE TO THE RELATED APPLICATIONS

This application is the national phase entry of International Application No. PCT/CN2023/120534, filed on Sep. 22, 2023, which is based upon and claims priority to Chinese Patent Application No. 202211162613.6, filed on Sep. 23, 2022, the entire contents of which are incorporated herein by reference.

TECHNICAL FIELD

The present invention belongs to the technical field of spinning processing, and more particularly, relates to a method for preparing profiled fibers with low lousiness rate by a polyester FDY process.

BACKGROUND

Profiled cross-section fibers are various fibers with different cross-sectional shapes produced by using spinnerets with non-circular holes in the spinning forming process, including triangular, trilobal, flat. Y-shaped, etc. Compared with circular cross-section fibers, the requirements of the production process and the equipment condition are higher, and lousiness is easier to generate in the operation process of the yarn path.

In the polyester fully drawn yarn (FDY) production process, a pre-entangling device is usually set after the fiber is oiled and before entering the godet roller. The function is mainly to evenly disperse the oil agent on the surface of the filament bundle on the surface of each monofilament, increase the fiber's bundling property and antistatic ability, improve the spinnability, and reduce the lousiness and the loose loop yarn. As shown in FIG. 1, the pre-entangling device 7 is installed on a pre-entangling panel 10, and the pre-entangling panel is further equipped with an upper row wire guide frame and a lower row wire guide frame for fixing wire guide ceramic pieces, and a entangling compressed-air inlet pipe; the filament bundle uses the upper and lower rows of wire guide ceramic pieces as the fulcrum, the entangling compressed-air sprays air flow through nozzles of the pre-entangling device in the pre-entangling yarn path to scatter and jitter the filament bundle, so that the oil agent on the surface of the filament bundle is evenly dispersed on the surface of each monofilament.

When producing fibers with special cross-sections, a large number of lousiness are easily generated on the pre-entangling device, and the appearance of the fibers is the lousiness and the loose loop yarn, which affects the product quality. The main defects of the existing equipment are: ① the pre-entangling wire guide ceramic pieces are all equally spaced (as shown in FIGS. 1-2), the width of the yarn path of the ceramic pieces is greater than the diameter of the filament bundle, and the filament bundle enters and exits the upper and lower rows of wire guide ceramic pieces at a certain angle, the fulcrum positions of the filament bundle on the ceramic pieces are different, and the filament bundle cannot remain vertical in the pre-entangling device yarn path, the inclined filament bundle collides with the ceramic pieces at the edge of the pre-entangling yarn path during the entangling process, which easily produces lousiness; ② the jitter effect of the filament bundle in the pre-entangling device is not only related to the size of the yarn path, the entangling nozzle and the entangling pressure, but also to the running tension and jitter distance of the running filament bundle, that is, the clamping distance of the upper and lower rows of wire guide ceramic pieces. However, the distance between the upper and lower rows of wire guide ceramic pieces in the existing equipment is fixed, as shown in FIG. 1, and the jitter distance of the filament bundle in the pre-entangling device cannot be changed, the filament bundle cannot produce the best jitter effect in the pre-entangling device only by adjusting the entangling pressure. If the entangling pressure is too small, the oil agent cannot be evenly dispersed on the surface of the fiber monofilaments, resulting in uneven oiling of the filament bundles, insufficient bonding force between the monofilaments, and easy generation of lousiness during the stretching process of godet rollers; if the entangling pressure is too large, it will cause entanglement and collision between the monofilaments, and the filament bundle will be coiled or broken, resulting in the lousiness and the loose loop yarn.

Therefore, it is of great practical significance to develop a method to reduce lousiness of profiled cross-section fibers by adjusting the pre-entangling wire guide frame.

SUMMARY

The present invention is to solve the above-mentioned problems existing in the prior art by providing a method for preparing profiled fibers with low lousiness rate by a polyester FDY process. The invention replaces the conventional fixed horizontal equidistant wire guide ceramic pieces with adjustable horizontal positions, and adjusts the horizontal distance of the wire guide ceramic pieces according to the different fulcrums of the filament bundles entering and exiting the wire guide ceramic pieces, so that the filament bundles remain vertical in the pre-entangling device; and changes the existing upper and lower rows of wire guide ceramic pieces with fixed longitudinal distances into ones with adjustable longitudinal distances, and adjusts the clamping distance of the filament bundles according to the characteristics of different varieties, so that the filament bundles achieve the best jitter effect in the pre-entangling device. Through these improvements, the lousiness in profiled cross-section fibers is greatly reduced.

To this end, the technical schemes of the invention are as follows:

A method for preparing profiled fibers with low lousiness rate by a polyester FDY process, wherein when preparing profiled fibers by the FDY process, during the operation of a yarn path, the horizontal and longitudinal positions of wire guide ceramic pieces on the pre-entangling wire guide frame are adjusted to maintain vertical alignment of the filament bundle in the pre-entangling device and achieve optimal jitter effect, so as to prepare profiled fibers with a low lousiness rate;

wherein the profiled fibers include triangular profiled fibers, trilobal profiled fibers or flat profiled fibers; when the profiled fibers are triangular profiled fibers, the lousiness rate is 0.35-0.65%; when the profiled fibers are trilobal profiled fibers, the lousiness rate is 0.85-1.25%; when the profiled fibers are flat profiled fibers, the lousiness rate is 0.5-0.85%; the method of the present invention can significantly reduce the lousiness rate of the produced profiled fibers;

wherein the jitter condition of the filament bundle in the pre-entangling device is detected by fiber optic sensors; wherein the optical fibers of the fiber optic sensors are divided into two groups, located directly in front of and behind the pre-entangling yarn path respectively (the front group being light-emitting fibers and the rear group being light-receiving fibers), both arranged in horizontal arrays along the horizontal symmetry axis of the pre-entangling device; wherein the diameter of the optical fibers is smaller than the monofilament diameter to ensure complete blockage of light emitted from the light-emitting fibers during the jitter process of monofilaments; wherein the fiber optic sensors detect the left and right deviation distances of all monofilaments passing vertically through the horizontal symmetry axis of the yarn path from top to bottom relative to the longitudinal central axis of the pre-entangling yarn path; the distance value of the longitudinal central axis of the pre-entangling yarn path is set to 0, with leftward distances as positive values and rightward distances as negative values; the computer central processing unit (CPU) collects the distance data, then counts and calculates the discrete distribution coefficient of variation (CV) value of the distances, and generates time-distance curves based on the distance data, at the maximum left jitter distance and maximum right jitter distance of the monofilaments, horizontal upper jitter limit line and lower jitter limit line are drawn respectively, with a center line drawn exactly midway between the upper and lower jitter limit lines; using the center line as a reference, the upper jitter limit line is shifted downward by 20% of the distance and the lower jitter limit line is shifted upward by 20% of the distance to define the upper boundary line and lower boundary line (horizontal lines) of the normal jitter range; then using the center line as a reference, the upper boundary line is shifted downward by 30% of the distance and the lower boundary line is shifted upward by 30% of the distance to define the upper offset line and lower offset line (horizontal lines); when the time-distance curve appears in the area above the upper boundary line or below the lower boundary line continuously for 2 ms, the entire area where the curve appears during this period is marked with a red rectangle and defined as a "long segment": when the curve appears only in the area between the upper offset line and lower offset line continuously for 2 ms, the entire area where the curve appears during this period is marked with a red rectangle and defined as a "short segment";

when the discrete distribution CV value of the distances is <3.5% (small CV value indicates uniform jitter), the center line coincides with the longitudinal central axis of the pre-entangling yarn path (i.e. the value is 0), and no "long segments" or "short segments" appear in the time-distance curve (meaning the filament bundle remains at the central axis of the pre-entangling device and maintains vertical alignment, with moderate jitter and no intermittent jitter), which indicates that the filament bundle maintains vertical alignment and achieves optimal jitter effect in the pre-entangling device.

Several optical fibers are distributed inside the pre-entangling yarn path, with fiber diameters smaller than the monofilament diameter to ensure complete blockage of light emitted by the fibers during the jitter process of monofilaments, photoelectric converters transform the light intensity received by the optical fibers into voltage signals, which are then compared with preset voltage signals in a comparator; if the voltage is lower than the preset value, it indicates the absence of the monofilament; otherwise, it indicates presence. The CPU then generates time-distance curves, and by analyzing these curves, it can detect whether the filament bundle is tilted in the pre-entangling device and determine the jitter condition of the filament bundle; by analyzing the jitter curves of the filament bundle, corresponding adjustments are made to the horizontal and longitudinal positions of the wire guide frame, enabling the filament bundle to maintain vertical alignment and achieve optimal jitter effect in the pre-entangling device, resulting in significant reduction of lousiness rate in profiled cross-section fibers.

The following preferred technology program is presented to give a detailed description for this invention:

The said method for preparing profiled fibers with low lousiness rate by a polyester FDY process, wherein a pre-entangling wire guide frame includes a channel frame, a wire guide ceramic piece, a positioning block, a pressure strip and a screw I, as well as a sliding groove and a screw II located at both ends of the channel frame, wherein the wire guide ceramic piece and the positioning block are installed inside the channel frame and fixed by the pressure strip and the screw I; wherein between the wire guide ceramic piece and the positioning block are installed in an alternating sequence of one positioning block, one wire guide ceramic piece, another positioning block and another wire guide ceramic piece, that is, one wire guide ceramic piece is installed between every two positioning blocks;

wherein the channel frame and the pre-entangling device are both horizontally arranged; wherein the pre-entangling device is fixed in the middle of the pre-entangling panel;

wherein the channel frame is divided into an upper row and a lower row, the upper row channel frame is located above the pre-entangling device while the lower row channel frame is located below the pre-entangling device;

wherein the sliding groove has an inwardly concave trapezoidal structure; wherein the pre-entangling panel has one slide rail on each side, and the slide rail has an outwardly convex trapezoidal structure matching the sliding groove; wherein the sliding groove is embedded in the slide rail and fixed with screw II, allowing the vertical distance between the upper and lower rows of wire guide ceramic pieces to be adjusted by moving the sliding groove up and down along the slide rail; wherein each end of the channel frame is equipped with a screw II, which includes a set screw and a handwheel, tightening the handwheel clockwise moves the connected set screw inward to press against the slide rail, thereby fixing the vertical distance between the upper and lower rows of wire guide ceramic pieces.

When the distance coordinate corresponding to the center line of the time-distance curve is positive and lousiness appears at the upper-left corner of the pre-entangling device, it indicates that the filament bundle is generally leftward and tilted counterclockwise in the pre-entangling yarn path, at this time, the size of the upper row positioning block should be adjusted to move the wire guide position of the upper row filament bundle to the right.

When the distance coordinate corresponding to the center line of the time-distance curve is positive and lousiness appears at the lower-left corner of the pre-entangling device, it indicates that the filament bundle is generally leftward and tilted clockwise in the pre-entangling yarn path, at this time, the size of the lower row positioning block should be adjusted to move the wire guide position of the lower row filament bundle to the right.

When the distance coordinate corresponding to the center line of the time-distance curve is negative and lousiness appears at the lower-right corner of the pre-entangling device, it indicates that the filament bundle is generally rightward and tilted counterclockwise in the pre-entangling yarn path, at this time, the size of the lower row positioning block should be adjusted to move the wire guide position of the lower row filament bundle to the left.

When the distance coordinate corresponding to the center line of the time-distance curve is negative and lousiness appears at the upper-right corner of the pre-entangling device, it indicates that the filament bundle is generally rightward and tilted clockwise in the pre-entangling yarn path, at this time, the size of the upper row positioning block should be adjusted to move the wire guide position of the upper row filament bundle to the left.

Based on the yarn path width of the ceramic pieces and the contact points of the filaments in the ceramic pieces, the minimum deviation in the width of the positioning blocks between ceramic pieces is machined to 0.25 mm, that is, the minimum horizontal adjustment range for the wire guide position is 0.25 mm each time.

When the curve shows a "long segment", it indicates that the filament bundle is jittering too violently, which causes the loose loop yarn due to interweaving and entanglement, or generates lousiness due to severe collisions between monofilaments. At this time, the vertical distance between the upper and lower channel frames should be reduced to increase the running tension of the filament bundle in the pre-entangling yarn path and shorten the jitter distance, thereby improving the jitter effect of the filament bundle. The adjustment range is generally 1 mm each time, moving the upper and lower wire guide frames closer to each other.

When the curve shows a "short segment," it indicates that the filament bundle is jittering insufficiently, which can cause intermittent jitter of monofilaments, resulting in uneven oiling of the filament bundle and generating lousiness during the stretching process of the godet rollers. At this time, the vertical distance between the upper and lower channel frames should be increased to reduce the running tension of the filament bundle in the pre-entangling yarn path and extend the jitter distance, thereby improving the jitter effect of the filament bundle. The adjustment range is generally 1 mm each time, moving the upper and lower wire guide frames away from each other.

The said method for preparing profiled fibers with low lousiness rate by a polyester FDY process, wherein the width of the positioning blocks is 3-5 mm, and the width of each positioning block may be equal or unequal.

The said method for preparing profiled fibers with low lousiness rate by a polyester FDY process, wherein the wire guide ceramic pieces installed in the upper row channel frame are U-shaped wire guide ceramic pieces, and those installed in the lower row channel frame are fishfork-shaped wire guide ceramic pieces (both U-shaped and fishfork-shaped wire guide ceramic pieces are well-known components in the field).

The said method for preparing profiled fibers with low lousiness rate by a polyester FDY process, wherein the width of the yarn path on all wire guide ceramic pieces is 1.5 mm, which is larger than the diameter of conventional profiled cross-section fibers.

The said method for preparing profiled fibers with low lousiness rate by a polyester FDY process, wherein the horizontal width of both U-shaped and fishfork-shaped wire guide ceramic pieces is 12 mm.

The said method for preparing profiled fibers with low lousiness rate by a polyester FDY process, wherein the surface of the slide rail is polished, and the inner surface of the sliding groove is also polished to ensure that the sliding groove can move up and down smoothly along the slide rail, thereby adjusting the vertical distance between the upper and lower rows of wire guide ceramic pieces.

The said method for preparing profiled fibers with low lousiness rate by a polyester FDY process, wherein a gap of 0.3-0.5 mm exists between the sliding groove and the slide rail on each side, to ensure that the sliding groove can move up and down easily along the slide rail.

The said method for preparing profiled fibers with low lousiness rate by a polyester FDY process, wherein the area near the slide rails on the pre-entangling panel is marked with scales, with 60 mm marked upward and downward from the horizontal symmetry axis of the pre-entangling panel as the reference.

The said method for preparing profiled fibers with low lousiness rate by a polyester FDY process, wherein the FDY process parameters are as follows: a winding speed of 3800-5300 m/min, a first godet roller speed of 2400-3980 m/min, a godet roller draw ratio of 1.1-1.6, a pre-entangling pressure of 0.025-0.055 MPa, and an oiling rate of 0.8-1.2%.

The said method for preparing profiled fibers with low lousiness rate by a polyester FDY process, wherein the sampling frequency of the fiber optic sensor is 100 kHz, that is, 1 ms collects 100 times of data.

Benefits:

The method for preparing profiled fibers with low lousiness rate by a polyester FDY process, by adjusting the horizontal and longitudinal positions of the pre-entangling wire guide frame, reduces lousiness caused by collisions between the filament bundle and the pre-entangling device during jittering, and lousiness and loose loop yarns formed by the filament bundle coiled or broken because of entanglement and collision between the monofilaments, as well as lousiness resulting from uneven oiling during the stretching process of the godet rollers, thereby significantly improving product quality.

Figure 1:
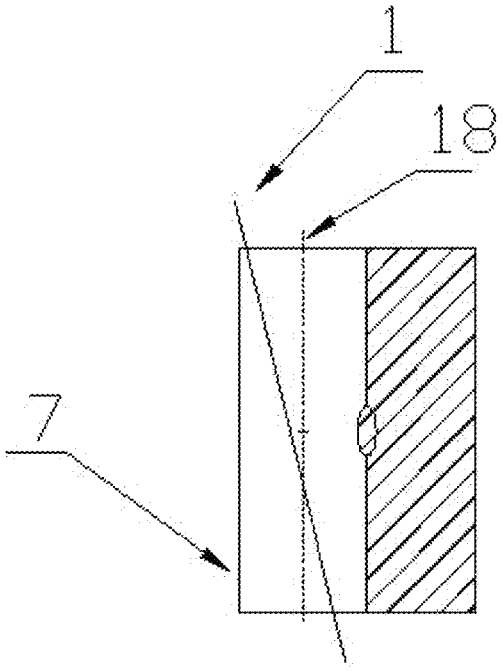
FIG. 1 (Prior Art)
FIG. 1 is a front view of a prior art pre-entangling device.
Figure 2:
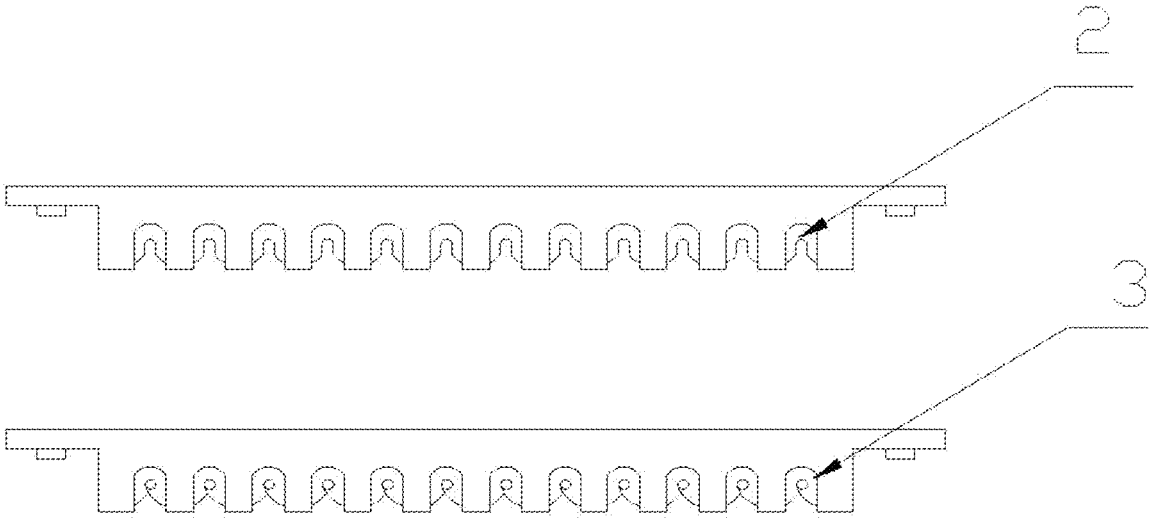
FIG. 2 (Prior Art)
FIG. 2 is a top view of the wire guide frame in the prior art pre-entangling device.
Figure 3:
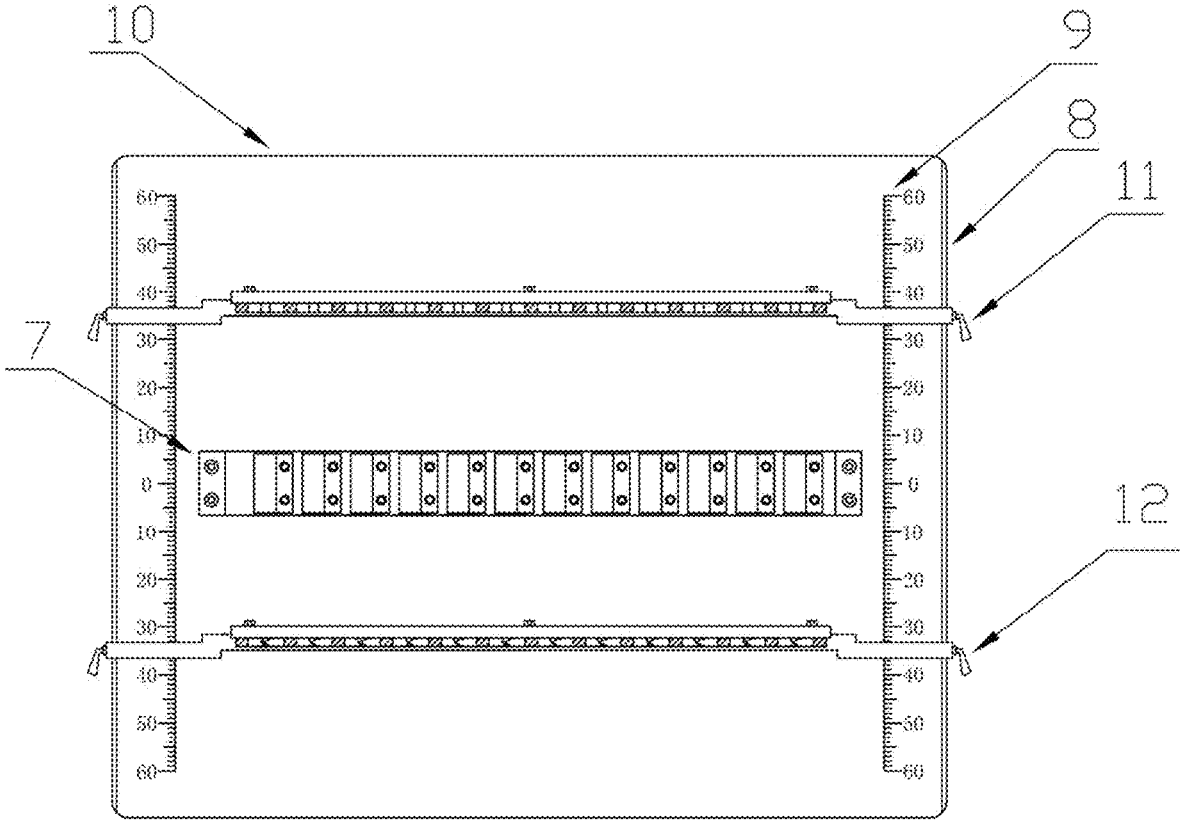
FIG. 3 is a front view of the pre-entangling device according to the present invention.
Figure 4:
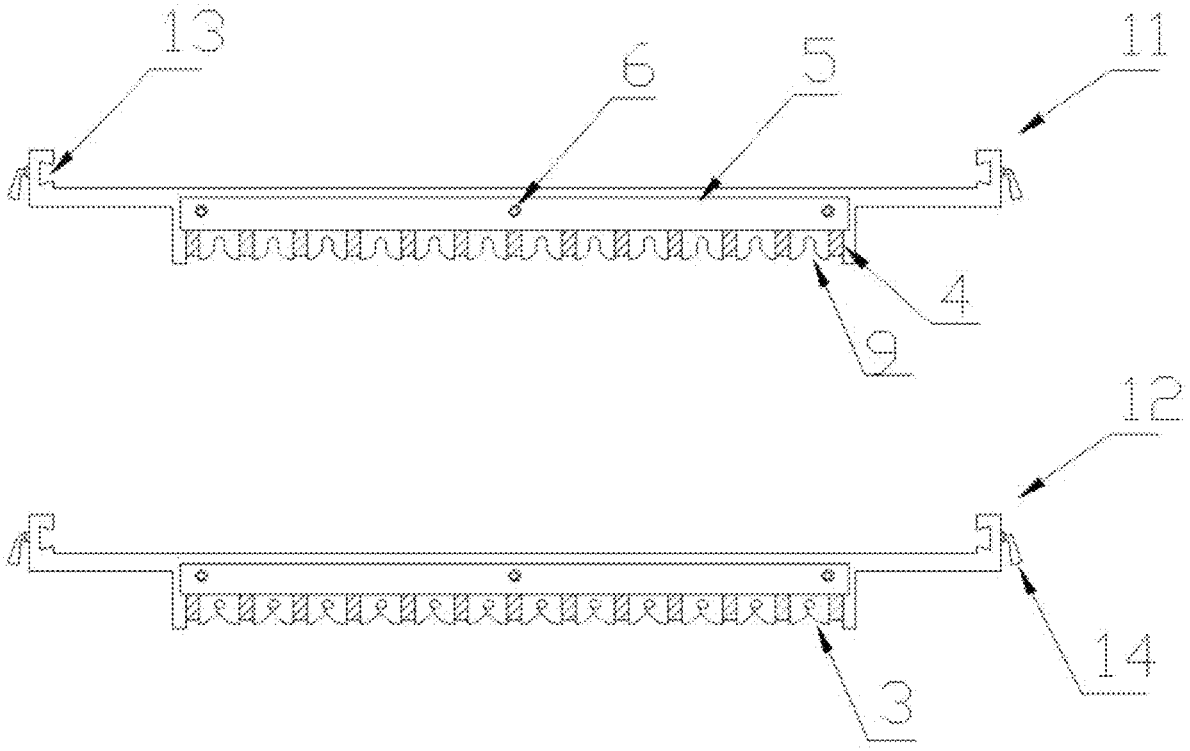
FIG. 4 is a top view of the wire guide frame in the pre-entangling device according to the present invention.
Figure 5:
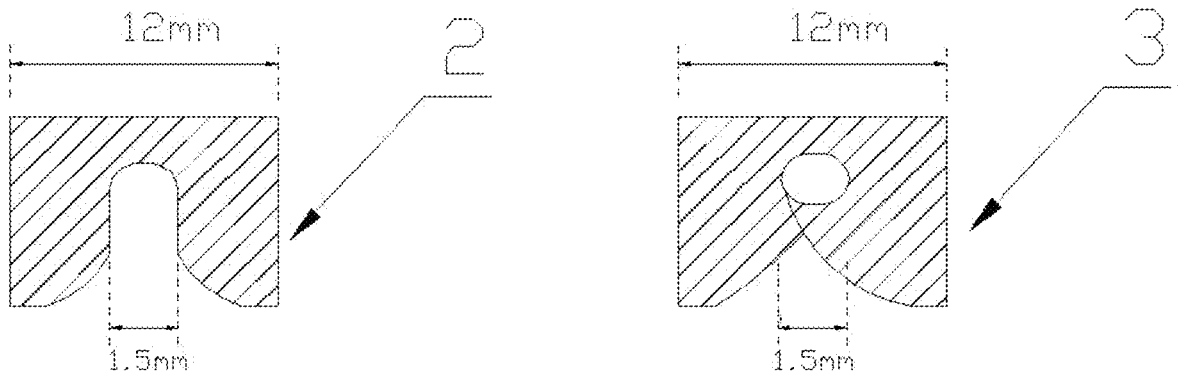
FIG. 5 is a top view of a wire guide ceramic piece.
Figure 6:
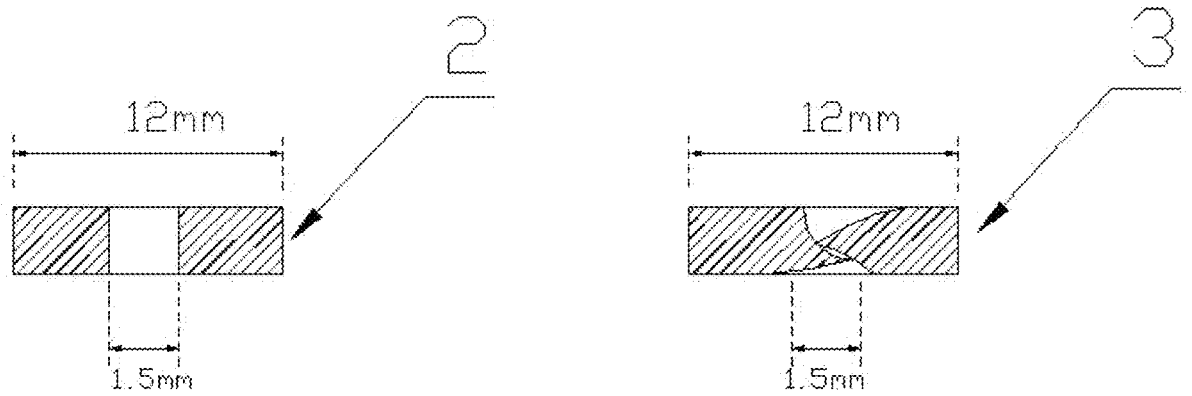
FIG. 6 is a front view of a wire guide ceramic piece.
Figure 7:
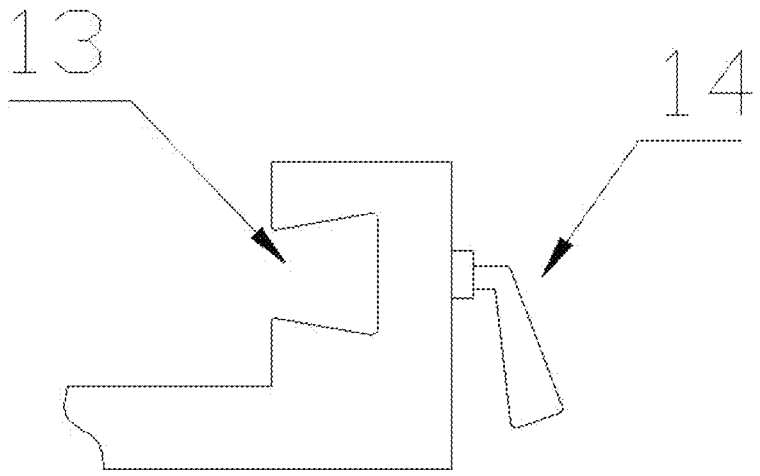
FIG. 7 is a top view of the sliding groove of the wire guide frame.
Figure 8:
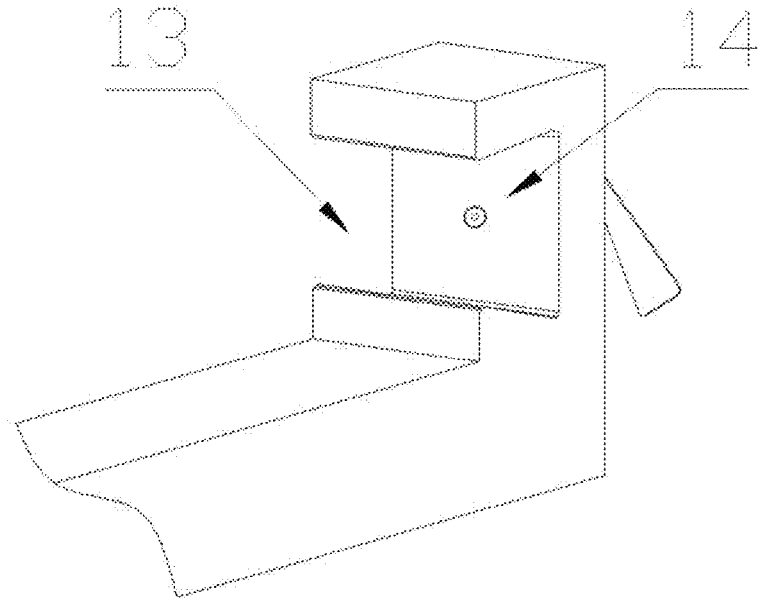
FIG. 8 is an oblique view of the sliding groove of the wire guide frame.
Figure 9:
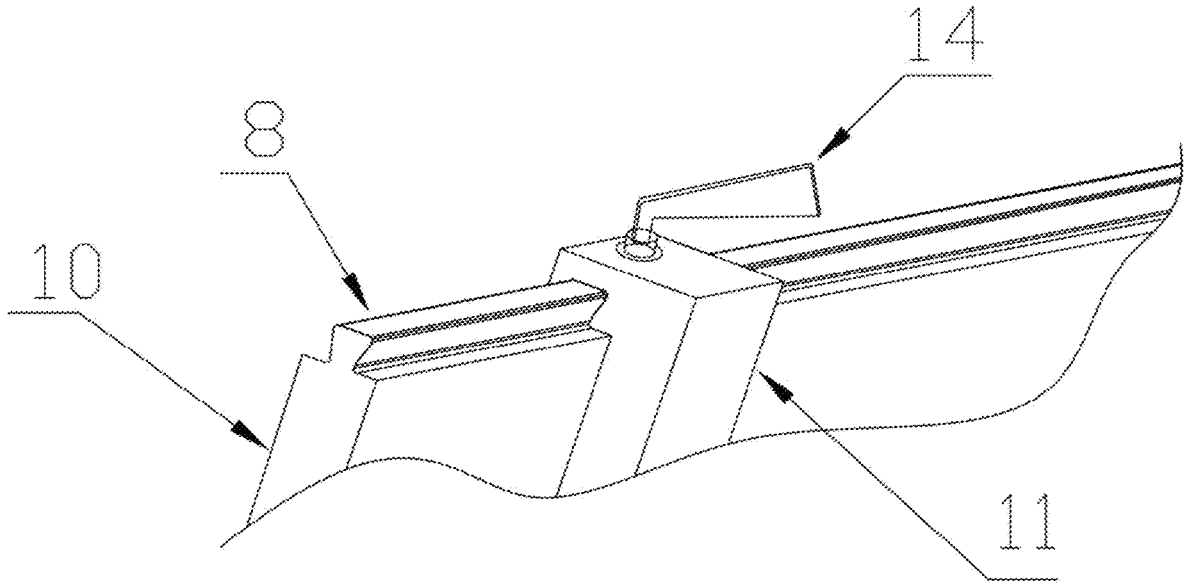
FIG. 9 is a partial schematic diagram of the upper row wire guide frame assembled on the pre-entangling panel.
Figure 10:
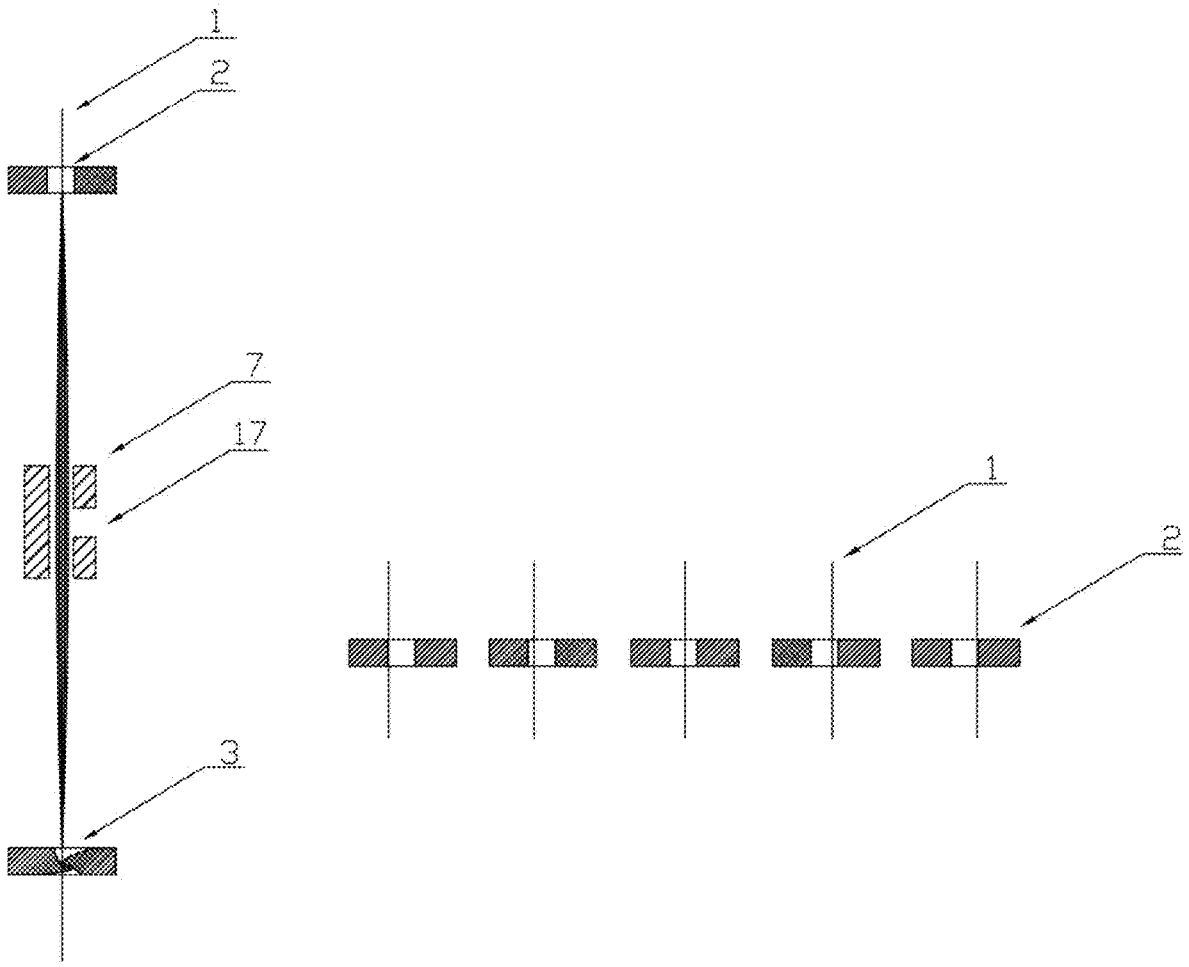
FIG. 10 is a schematic diagram showing the state of the filament bundle in the pre-entangling device and different fulcrum points of the filament bundle on the ceramic pieces.
Figure 11:
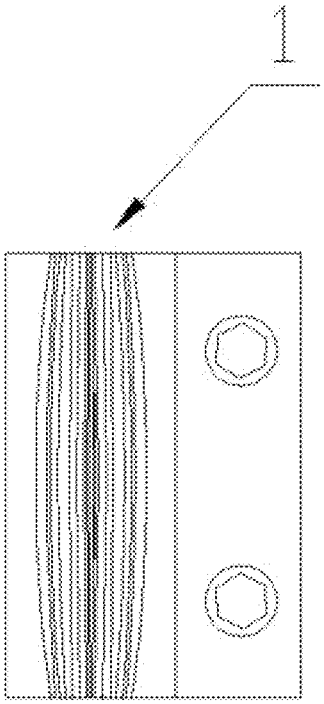
FIG. 11 is a schematic diagram of the filament bundle jittering in the pre-entangling device.
Figure 12:
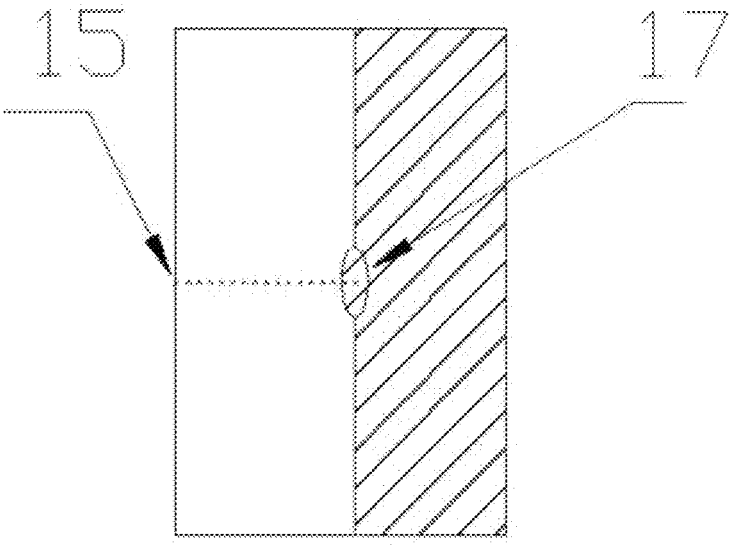
FIG. 12 is a front view showing the distribution of optical fibers in the pre-entangling device.
Figure 13:
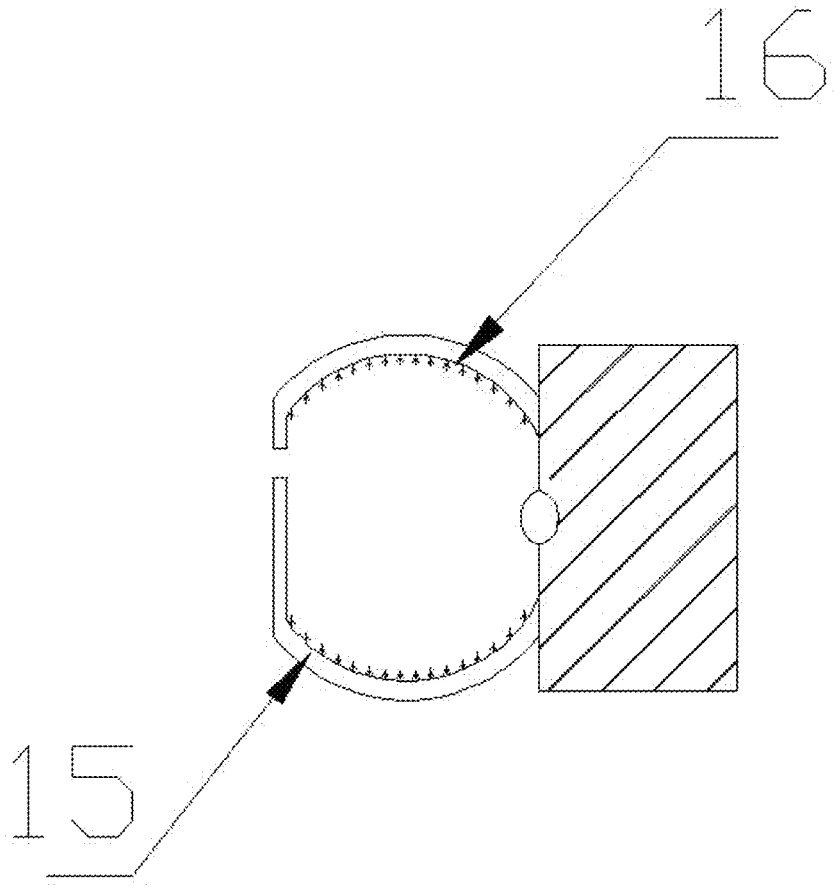
FIG. 13 is a top view showing the distribution of optical fibers in the pre-entangling device.

wherein the numbers in the figures are respectively represented: 1—filament bundle, 2—U-shaped ceramic piece, 3—fishfork-shaped ceramic piece, 4—positioning block, 5—pressure strip, 6—screw I, 7—pre-entangling device, 8—slide rail, 9—scale, 10—pre-entangling panel, 11—upper row channel frame, 12—lower row channel frame, 13—sliding groove, 14—screw II, 15—light-emitting fiber, 16—light-receiving fiber, 17—air jet hole, 18—longitudinal central axis of the pre-entangling yarn path, 19—center line, 20—upper jitter limit line, 21—lower jitter limit line, 22—upper boundary line, 23—lower boundary line, 24—upper offset line, 25—lower offset line, 26—long segment, 27—short segment.

DETAILED DESCRIPTION OF THE EMBODIMENTS

Based on above mentioned method, the following embodiments are carried out for further demonstration in the present invention. It is to be understood that these embodiments are only intended to illustrate the invention and are not intended to limit the scope of the invention. In addition, it should be understood that after reading the contents described in the present invention, those technical personnel in this field can make various changes or modifications to the invention, and these equivalent forms also fall within the scope of the claims attached to the application.

A pre-entangling device, as shown in FIGS. 3-9, includes a pre-entangling panel 10, a pre-entangling device 7, and a pre-entangling wire guide frame; wherein the pre-entangling device 7 is fixed at the center of the pre-entangling panel 10;

wherein the pre-entangling wire guide frame includes channel frames, wire guide ceramic pieces, positioning blocks 4, pressure strips 5, screws I 6, as well as sliding grooves 13 and screws II 14 located at both ends of the channel frames; wherein the channel frames are divided into an upper row and a lower row, the upper row channel frame 11 is located above the pre-entangling device 7, while the lower row channel frame 12 is located below the pre-entangling device 7, both the upper and lower row channel frames are horizontally arranged relative to the pre-entangling device 7; wherein the sliding grooves feature an inwardly concave trapezoidal structure; wherein the pre-entangling panel 10 has a vertical slide rail 8 on each side, with an outwardly convex trapezoidal structure matching the sliding groove profile; wherein the sliding grooves 13 are embedded in the slide rails 8 and secured using screw II 14; wherein the surface of the slide rail 8 is polished, and the inner surface of the sliding groove 13 is also polished, with a 0.3-0.5 mm gap maintained between the sliding groove and the slide rail to ensure smooth vertical movement for adjusting the longitudinal distance between the upper and lower rows of wire guide ceramic pieces; wherein the area near the slide rails 8 on the pre-entangling panel 10 is marked with scales 9, with 60 mm marked upward and downward from the horizontal symmetry axis of the pre-entangling panel as the reference;

wherein the wire guide ceramic pieces installed in the upper row channel frame 11 are U-shaped ceramic pieces 2, while those installed in the lower row channel frame 12 are fishfork-shaped ceramic pieces 3; wherein the horizontal width of both U-shaped and fishfork-shaped wire guide ceramic pieces is 12 mm, and the yarn path width on all wire guide ceramic pieces is 1.5 mm; wherein the wire guide ceramic pieces and positioning blocks 4 are installed inside the channel frame and fixed by pressure strips 5 and screws I 6; wherein between the wire guide ceramic pieces and the positioning blocks 4 are installed in an alternating sequence of one positioning block, one wire guide ceramic piece, another positioning block, and then another wire guide ceramic piece; wherein the width of the positioning blocks is 3-5 mm, and the width of each positioning block may be equal or unequal; wherein the minimum deviation in the width of the positioning blocks between ceramic pieces is machined to 0.25 mm, that is, the minimum horizontal adjustment range for the wire guide position is 0.25 mm each time.

Figure 14:
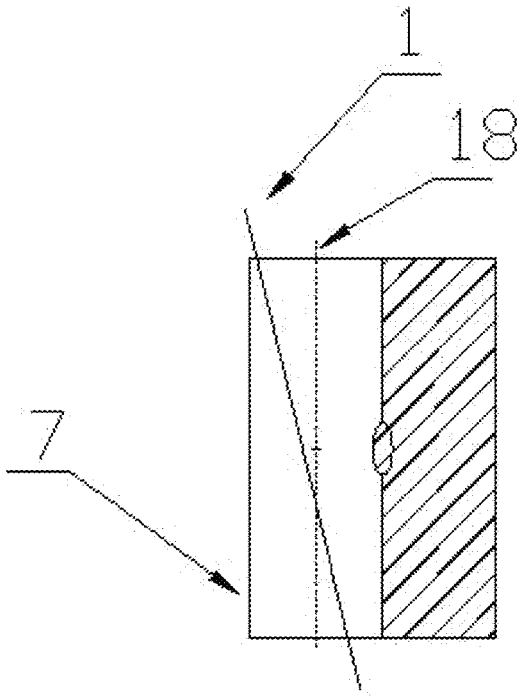
FIG. 14 is a schematic diagram showing the state where the filament bundle is generally leftward and tilted counterclockwise in the pre-entangling yarn path.
Figure 15:
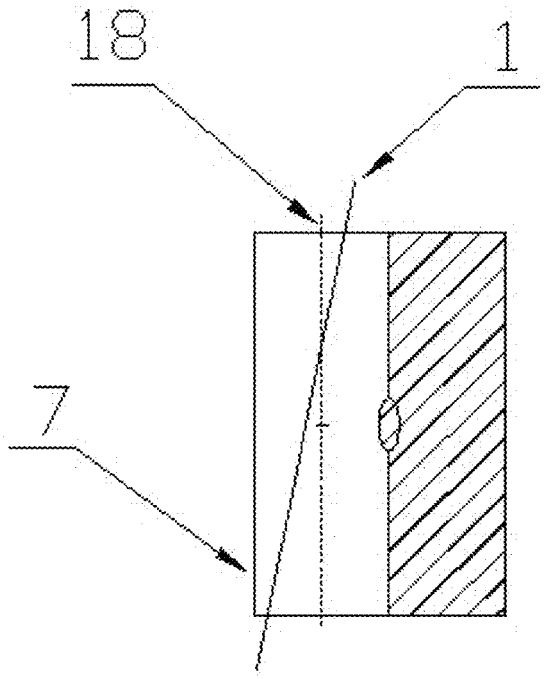
FIG. 15 is a schematic diagram showing the state where the filament bundle is generally leftward and tilted clockwise in the pre-entangling yarn path.
Figure 16:
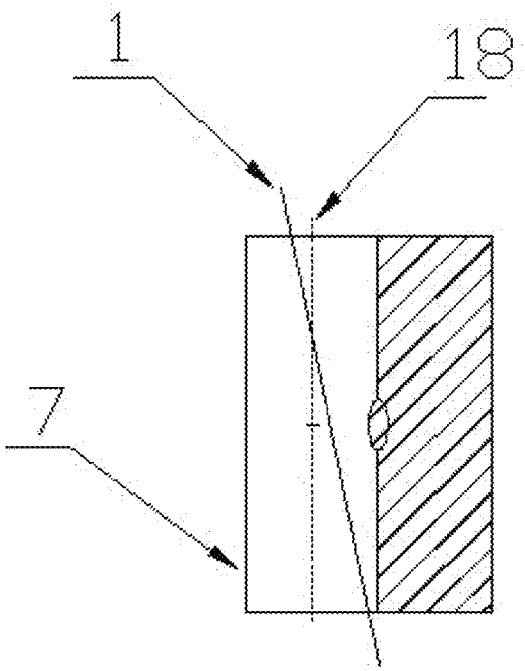
FIG. 16 is a schematic diagram showing the state where the filament bundle is generally rightward and tilted counterclockwise in the pre-entangling yarn path.
Figure 17:
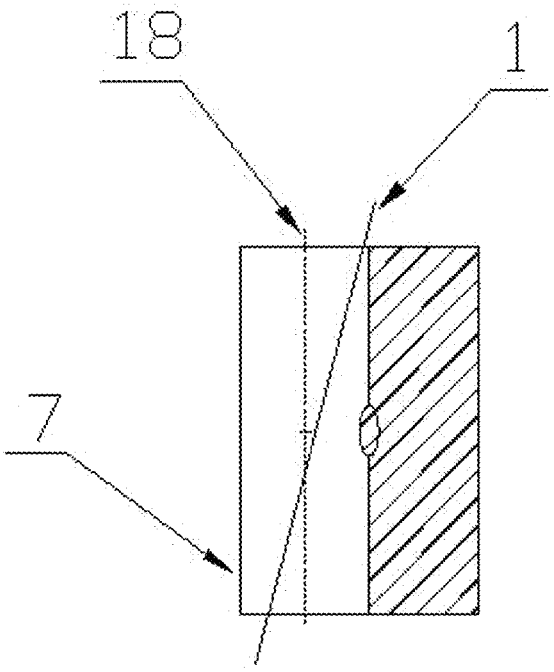
FIG. 17 is a schematic diagram showing the state where the filament bundle is generally rightward and tilted clockwise in the pre-entangling yarn path.
Figure 18:
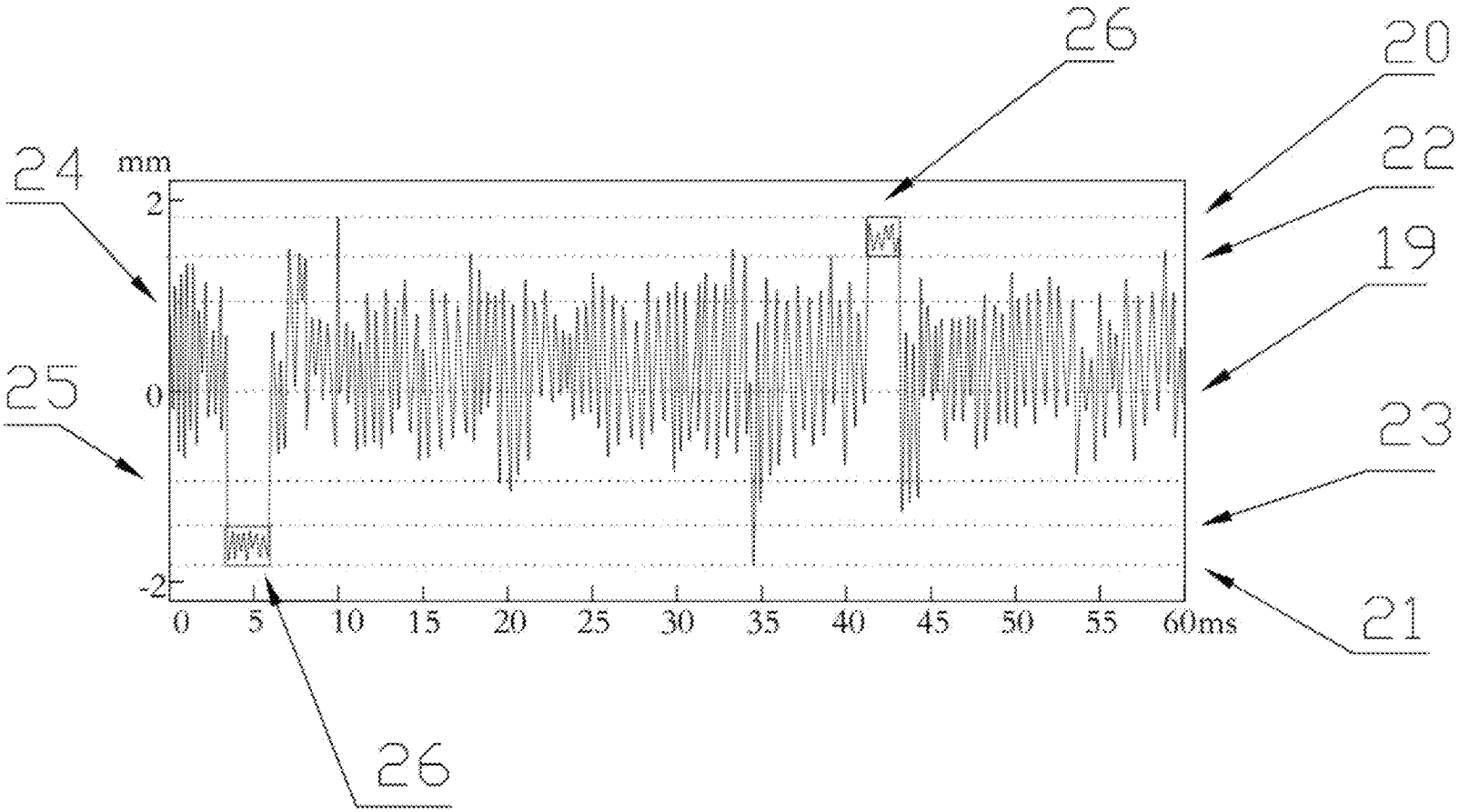
FIG. 18 is a time-distance curve graph showing a "long segment"
Figure 19:
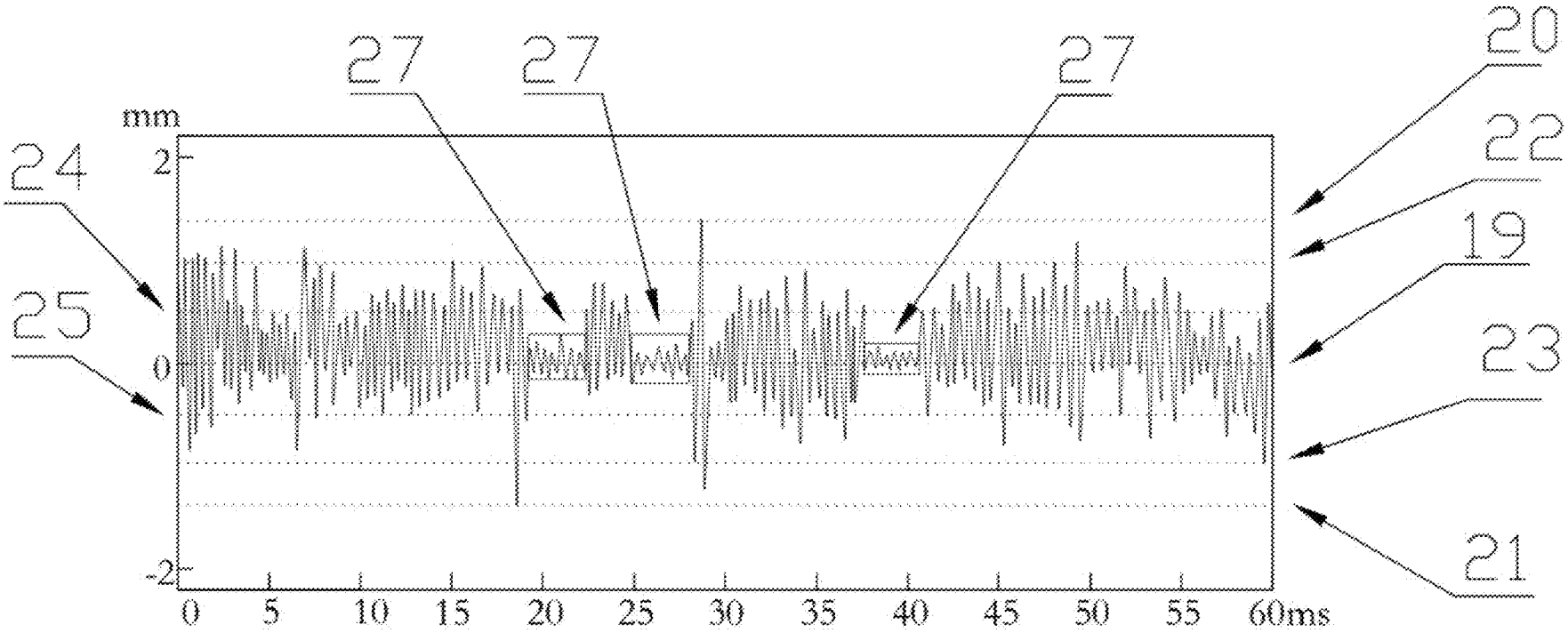
FIG. 19 is a time-distance curve graph showing a "short segment"

As shown in FIGS. 10-13, the filament bundle 1 passes through the pre-entangling device 7, where compressed air is blown from the air jet holes 17 to make the filament bundle jitter, the jitter condition of the filament bundle is detected by fiber optic sensors; the optical fibers of the fiber optic sensors are divided into two groups, located directly in front of and behind the pre-entangling yarn path respectively (the front group being light-emitting fibers 15 and the rear group being light-receiving fibers 16), both arranged in horizontal arrays along the horizontal symmetry axis of the pre-entangling device; wherein the sampling frequency of the fiber optic sensors is 100 kHz, that is, 1 ms collects 100 times of data; wherein the diameter of the optical fibers is smaller than that of the monofilaments; wherein the fiber optic sensors detect the left and right deviation distances of all monofilaments passing vertically through the horizontal symmetry axis of the yarn path from top to bottom relative to the longitudinal central axis 18 of the pre-entangling yarn path, the distance value of the longitudinal central axis of the pre-entangling yarn path is set to 0, with leftward distances as positive values and rightward distances as negative values; the computer CPU collects the distance data, then counts and calculates the discrete distribution CV value of the distances, and generates time-distance curves based on the distance data, as shown in FIGS. 18-19, at the maximum left jitter distance and maximum right jitter distance of the monofilaments, horizontal upper jitter limit line 20 and lower jitter limit line 21 are drawn respectively, with a center line 19 drawn exactly midway between the upper and lower jitter limit lines; using the centerline as a reference, the upper jitter limit line is shifted downward by 20% of the distance, and the lower jitter limit line is shifted upward by 20% of the distance to define the upper boundary line 22 and lower boundary line 23 (horizontal lines) of the normal jitter range; then using the center line as a reference, the upper boundary line is shifted downward by 30% of the distance, and the lower boundary line is shifted upward by 30% of the distance to define the upper offset line 24 and lower offset line 25 (horizontal lines); when the time-distance curve appears in the area above the upper boundary line or below the lower boundary line continuously for 2 ms, the entire area where the curve appears during this period is defined as a "long segment" 26; when the curve appears only in the area between the upper offset line and the lower offset line continuously for 2 ms, the entire area where the curve appears during this period is defined as a "short segment" 27;

when the discrete distribution CV value of the distances is <3.5%, the center line coincides with the longitudinal central axis of the pre-entangling yarn path 18, and no "long segments" or "short segments" appear in the time-distance curve, which indicates that the filament bundle maintains vertical alignment and achieves optimal jitter effect in the pre-entangling device;

when the distance coordinate corresponding to the center line of the time-distance curve is positive and lousiness appears at the upper-left corner of the pre-entangling device, it indicates that the filament bundle is generally leftward and tilted counterclockwise in the pre-entangling yarn path (as shown in FIG. 14), at this time, the size of the upper row positioning block in the pre-entangling device should be adjusted to move the wire guide position of the upper row filament bundle to the right;

when the distance coordinate corresponding to the center line of the time-distance curve is positive and lousiness appears at the lower-left corner of the pre-entangling device, it indicates that the filament bundle is generally leftward and tilted clockwise in the pre-entangling yarn path (as shown in FIG. 15), at this time, the size of the lower row positioning block in the pre-entangling device should be adjusted to move the wire guide position of the lower row filament bundle to the right;

when the distance coordinate corresponding to the center line of the time-distance curve is negative and lousiness appears at the lower-right corner of the pre-entangling device, it indicates that the filament bundle is generally rightward and tilted counterclockwise in the pre-entangling yarn path (as shown in FIG. 16), at this time, the size of the lower row positioning block in the pre-entangling device should be adjusted to move the wire guide position of the lower row filament bundle to the left;

when the distance coordinate corresponding to the center line of the time-distance curve is negative and lousiness appears at the upper-right corner of the pre-entangling device, it indicates that the filament bundle is generally rightward and tilted clockwise in the pre-entangling yarn path (as shown in FIG. 17), at this time, the size of the upper row positioning block in the pre-entangling device should be adjusted to move the wire guide position of the upper row filament bundle to the left;

as shown in FIG. 18, when the curve shows the "long segment", it indicates that the filament bundle is jittering too violently, which causes the loose loop yarn due to interweaving and entanglement, or generates lousiness due to severe collisions between monofilaments; at this time, the vertical distance between the upper and lower channel frames should be reduced to increase the running tension of the filament bundle in the pre-entangling yarn path and shorten the jitter distance, thereby improving the jitter effect of the filament bundle; the adjustment range is generally 1 mm each time, moving the upper and lower wire guide frames closer to each other;

as shown in FIG. 19, when the curve shows the "short segment," it indicates that the filament bundle is jittering insufficiently, which can cause intermittent jitter of monofilaments, resulting in uneven oiling of the filament bundle and generating lousiness during the stretching process of the godet rollers. At this time, the vertical distance between the upper and lower channel frames should be increased to reduce the running tension of the filament bundle in the pre-entangling yarn path and extend the jitter distance, thereby improving the jitter effect of the filament bundle. The adjustment range is generally 1 mm each time, moving the upper and lower wire guide frames away from each other.

The text method for lousiness rate of profiled fibers in the present invention is according to the industry standard FZ/T 50054-2021 "Man-made fiber—On-line and intelligent detection of appearance defects for yarn package".

Example 1

A method for preparing trilobal profiled fibers with low lousiness rate by a polyester FDY process is as follows: using the said pre-entangling device, the number of upper and lower rows of wire guide ceramic pieces are both 12, when preparing the trilobal profiled fibers by the FDY process, during the operation of yarn path, the horizontal and longitudinal positions of wire guide ceramic pieces on the pre-entangling wire guide frame are adjusted to maintain vertical alignment of the filament bundle in the pre-entangling device and achieve optimal jitter effect, so as to prepare 55 dtex/72 f trilobal profiled fibers;

wherein the FDY process parameters are as follows: a winding speed of 4900 m/min, a first godet roller speed of 3875 m/min, a godet roller draw ratio of 1.32, a pre-entangling pressure of 0.05 MPa, and an oiling rate of 1.18%;

when the filament bundle is kept vertical in the pre-entangling device and optimal jitter effect is achieved, the widths of the 1-13 #positioning blocks between the upper row of U-shaped ceramic pieces are 4.5 mm, 4 mm, 4 mm, 4.25 mm, 4 mm, 4.25 mm, 4 mm, 3.75 mm, 4 mm, 3.5 mm, 4 mm, 4 mm, 4.5 mm respectively, and the widths of the 1-13 #positioning blocks between the lower row of fishfork-shaped ceramic pieces are 3.5 mm, 4 mm, 4 mm, 4 mm, 4 mm, 4 mm, 4 mm, 4 mm, 4.5 mm, 4 mm, 4.5 mm, 4 mm, 4.5 mm respectively; the distance between the upper and lower rows of wire guide ceramic pieces is 82 mm;

wherein the lousiness rate of the prepared 55 dtex/72 f trilobal profiled fibers is 1.03%.

Comparison 1

A method for preparing trilobal profiled fibers by a polyester FDY process, basically is the same as Example 1, except that using the prior art pre-entangling device as shown in FIG. 1, and the distance between two adjacent wire guide ceramic pieces is fixed to 4 mm, while the distance between the upper and lower rows of wire guide ceramic pieces is fixed to 70 mm;

wherein the lousiness rate of the prepared 55 dtex/72 f trilobal profiled fibers is 2.28%.

Comparing Comparison 1 with Example 1, it can be seen that the lousiness rate of Example 1 is reduced by 1.25%, because when preparing trilobal cross-section fibers with specification of 55 dtex/72 f, the monofilament number of fibers is high and the cross-section of the specific surface area is large, the prior art can only increase the entangling pressure to make the fibers be evenly oiled, which can easily cause entanglement and collision between the monofilaments to produce the lousiness and the loose loop yarn; the present invention adjusts the distance between the upper and lower rows of wire guide ceramic pieces from 70 mm to 82 mm, and optimizes the jitter effect of the filament bundle by adjusting the width of each positioning block, thereby reducing the lousiness rate of the profiled fiber.

Example 2

A method for preparing triangular profiled fibers with low lousiness rate by a polyester FDY process is as follows: using the said pre-entangling device, the number of upper and lower rows of wire guide ceramic pieces are both 12, when preparing the triangular profiled fibers by the FDY process, during the operation of yarn path, the horizontal and longitudinal positions of wire guide ceramic pieces on the pre-entangling wire guide frame are adjusted to maintain vertical alignment of the filament bundle in the pre-entangling device and achieve optimal jitter effect, so as to prepare 53 dtex/36 f triangular profiled fibers;

wherein the FDY process parameters are as follows: a winding speed of 5000 m/min, a first godet roller speed of 3650 m/min, a godet roller draw ratio of 1.39, a pre-entangling pressure of 0.045 MPa, and an oiling rate of 1.12%;

when the filament bundle is kept vertical in the pre-entangling device and optimal jitter effect is achieved, the widths of the 1-13 #positioning blocks between the upper row of U-shaped ceramic pieces are 4.25 mm, 4 mm, 4 mm, 4.5 mm, 4 mm, 4.25 mm, 4 mm, 3.5 mm, 4 mm, 3.75 mm, 4 mm, 4.25 mm, 4.25 mm respectively, and the widths of the 1-13 #positioning blocks between the lower row of fishfork-shaped ceramic pieces are 3.75 mm, 4 mm, 4 mm, 4 mm, 4 mm, 4 mm, 4 mm, 4 mm, 4.25 mm, 4 mm, 4.25 mm, 4 mm, 4.25 mm respectively; the distance between the upper and lower rows of wire guide ceramic pieces is 58 mm;

wherein the lousiness rate of the prepared 53 dtex/36 f triangular profiled fibers is 0.55%.

Comparison 2

A method for preparing triangular profiled fibers by a polyester FDY process, basically is the same as Example 2, except that using the prior art pre-entangling device as shown in FIG. 1, and the distance between two adjacent wire guide ceramic pieces is fixed to 4 mm, while the distance between the upper and lower rows of wire guide ceramic pieces is fixed to 70 mm;

wherein the lousiness rate of the prepared 53 dtex/36 f triangular profiled fibers is 1.60%.

Comparing Comparison 2 with Example 2, it can be seen that the lousiness rate of Example 2 is reduced by 1.05%, because when preparing 53 dtex/36 f triangular profiled fibers, the distance between the upper and lower rows of wire guide ceramic pieces is adjusted from 70 mm to 58 mm, the jitter effect of the filament bundle in the pre-entangling is optimized by adjusting the width of each positioning block, thereby reducing the lousiness rate of the profiled fiber.

Example 3

A method for preparing flat profiled fibers with low lousiness rate by a polyester FDY process is as follows: using the said pre-entangling device, the number of upper and lower rows of wire guide ceramic pieces are both 12, when preparing the flat profiled fibers by the FDY process, during the operation of yarn path, the horizontal and longitudinal positions of wire guide ceramic pieces on the pre-entangling wire guide frame are adjusted to maintain vertical alignment of the filament bundle in the pre-entangling device and achieve optimal jitter effect, so as to prepare 33 dtex/24 f flat profiled fibers;

wherein the FDY process parameters are as follows: a winding speed of 5200 m/min, a first godet roller speed of 3850 m/min, a godet roller draw ratio of 1.38, a pre-entangling pressure of 0.035 MPa, and an oiling rate of 1.02%;

when the filament bundle is kept vertical in the pre-entangling device and optimal jitter effect is achieved, the widths of the 1-13 #positioning blocks between the upper row of U-shaped ceramic pieces are 4 mm, 4.25 mm, 4 mm, 4.5 mm, 4.25 mm, 4 mm, 4 mm, 3.75 mm, 4 mm, 3.75 mm, 4 mm, 4.25 mm, 4 mm respectively, and the widths of the 1-13 #positioning blocks between the lower row of fishfork-shaped ceramic pieces are 3.5 mm, 4 mm, 4.25 mm, 4 mm, 4 mm, 4 mm, 4 mm, 4.25 mm, 4 mm, 4 mm, 4 mm, 4.25 mm, 4.25 mm respectively; the distance between the upper and lower rows of wire guide ceramic pieces is 64 mm;

wherein the lousiness rate of the prepared 33 dtex/24 f flat profiled fibers is 0.67%.

Comparison 3

A method for preparing flat profiled fibers by a polyester FDY process, basically is the same as Example 3, except that using the prior art pre-entangling device as shown in FIG. 1, and the distance between two adjacent wire guide ceramic pieces is fixed to 4 mm, while the distance between the upper and lower rows of wire guide ceramic pieces is fixed to 70 mm;

wherein the lousiness rate of the prepared 33 dtex/24 f flat profiled fibers is 2.01%.

Comparing Comparison 3 with Example 3, it can be seen that the lousiness rate of Example 3 is reduced by 1.34%, because when preparing 33 dtex/24 f flat profiled fibers, the distance between the upper and lower rows of wire guide ceramic pieces is adjusted from 70 mm to 64 mm, the jitter effect of the filament bundle in the pre-entangling is optimized by adjusting the width of each positioning block, thereby reducing the lousiness rate of the profiled fiber.

What is claimed is:

1. A method for preparing profiled fibers with a low lousiness rate by a polyester fully drawn yarn (FDY) process, comprising that: when preparing the profiled fibers by the FDY process, horizontal and longitudinal positions of wire guide ceramic pieces on a pre-entangling wire guide frame are adjusted to maintain a vertical alignment of a filament bundle in a pre-entangling device having a pre-entangling yarn path and achieve an optimal jitter effect of the filament bundle in the pre-entangling yarn path, so as to prepare the profiled fibers with the low lousiness rate;

wherein the profiled fibers comprise triangular profiled fibers, trilobal profiled fibers or flat profiled fibers; when the profiled fibers are the triangular profiled fibers, a lousiness rate is 0.35-0.65%; when the profiled fibers are the trilobal profiled fibers, the lousiness rate is 0.85-1.25%;

when the profiled fibers are the flat profiled fibers, the lousiness rate is 0.5-0.85%;

wherein a jitter condition of the filament bundle in the pre-entangling device is detected by fiber optic sensors; wherein optical fibers of the fiber optic sensors are divided into two groups, located directly in front of and behind the pre-entangling yarn path respectively, both arranged in horizontal arrays along a horizontal symmetry axis of the pre-entangling device;

wherein a diameter of the optical fibers is smaller than a diameter of each monofilament in the filament bundle; wherein the fiber optic sensors detect left and right deviation distances of all monofilaments passing vertically from top to bottom through the horizontal symmetry axis relative to a longitudinal central axis of the pre-entangling yarn path; a distance value corresponding to the longitudinal central axis of the pre-entangling yarn path is set to 0, with leftward distances as positive values and rightward distances as negative values; a computer central processing unit (CPU) collects distance data, then counts and calculates a discrete distribution coefficient of variation (CV) value of the deviation distances, and generates a time-distance curve based on the distance data, at a maximum left jitter distance and a maximum right jitter distance of the monofilaments, a horizontal upper jitter limit line and a lower jitter limit line are drawn respectively, with a center line drawn exactly midway between the upper and lower jitter limit lines; using the center line as a reference, the upper jitter limit line is shifted downward by 20% of a distance between the upper jitter limit line and the lower jitter limit line and the lower jitter limit line is shifted upward by 20% of the distance between the upper jitter limit line and the lower jitter limit line to define an upper boundary line and a lower boundary line of a normal jitter range; then using the center line as the reference, the upper boundary line is shifted downward by 30% of the distance between the upper jitter limit line and the lower jitter limit line and the lower boundary line is shifted upward by 30% of the distance between the upper jitter limit line and the lower jitter limit line to define an upper offset line and a lower offset line;

when the time-distance curve appears in an area above the upper boundary line or below the lower boundary line continuously for 2 ms, the entire area where the curve appears during this period is defined as a "long segment"; when the curve appears only in an area between the upper offset line and the lower offset line continuously for 2 ms, the entire area where the curve appears during this period is defined as a "short segment";

when the discrete distribution coefficient of variation (CV) value of the deviation distances is <3.5%, the center line coincides with the longitudinal central axis of the pre-entangling yarn path, and no "long segments" or "short segments" appear in the time-distance curve, so that the filament bundle maintains the vertical alignment and achieves the optimal jitter effect in the pre-entangling device, the optimal jitter effect being defined by the discrete distribution coefficient of variation (CV) value being <3.5%, the center line coinciding with the longitudinal central axis of the pre-entangling yarn path, and the absence of "long segments" and "short segments".

2. The method of claim 1, wherein the pre-entangling wire guide frame comprises a channel frame, wire guide ceramic pieces, positioning blocks, a pressure strip and a first screw, as well as a sliding groove and a second screw located at both ends of the channel frame, wherein the wire guide ceramic pieces and the positioning blocks are installed inside the channel frame and fixed by the pressure strip and the first screw; wherein each wire guide ceramic piece is installed between two adjacent positioning blocks, in an alternating sequence of positioning blocks and wire guide ceramic pieces;

wherein the channel frame and the pre-entangling device are both horizontally arranged; wherein the pre-entangling device is fixed in a middle of a pre-entangling panel;

wherein the channel frame is divided into an upper row and a lower row, the upper row channel frame is located above the pre-entangling device while the lower row channel frame is located below the pre-entangling device;

wherein the sliding groove has an inwardly concave trapezoidal structure; wherein the pre-entangling panel has one slide rail on each side, and the slide rail has an outwardly convex trapezoidal structure matching the sliding groove; wherein the sliding groove is embedded in the slide rail and fixed with the second screw, allowing a vertical distance between upper and lower rows of the wire guide ceramic pieces to be adjusted by moving the sliding groove up and down along the slide rail.

3. The method of claim 2, wherein a width of the positioning blocks is 3-5 mm.

4. The method of claim 2, wherein the wire guide ceramic pieces installed in the upper row channel frame are U-shaped wire guide ceramic pieces, and those installed in the lower row channel frame are fishfork-shaped wire guide ceramic pieces.

5. The method of claim 4, wherein a width of the yarn path on all wire guide ceramic pieces is 1.5 mm.

6. The method of claim 5, wherein a horizontal width of both the U-shaped and the fishfork-shaped wire guide ceramic pieces is 12 mm.

7. The method of claim 2, wherein a surface of the slide rail is polished, and an inner surface of the sliding groove is also polished.

8. The method of claim 2, wherein a gap of 0.3-0.5 mm exists between the sliding groove and the slide rail on each side.

9. The method of claim 2, wherein an area near the slide rails on the pre-entangling panel is marked with scales.

10. The method of claim 1, wherein FDY process parameters are as follows: a winding speed of 3800-5300 m/min, a first godet roller speed of 2400-3980 m/min, a godet roller draw ratio of 1.1-1.6, a pre-entangling pressure of 0.025-0.055 MPa, and an oiling rate of 0.8-1.2%.

11. The method of claim 1, wherein a sampling frequency of the fiber optic sensor is 100 kHz.

* * * * *